US009916943B2

(12) United States Patent
Lin et al.

(10) Patent No.: US 9,916,943 B2
(45) Date of Patent: Mar. 13, 2018

(54) LINKAGE MECHANISM AND PRESS KEY INCLUDING THE SAME

(71) Applicant: Sunrex Technology Corp., Taichung (TW)

(72) Inventors: Shih-Pin Lin, Taichung (TW); Yu-Yin Liu, Taichung (TW); Liang-Dong Yang, Taichung (TW); Yu-Yao Shih, Taichung (TW)

(73) Assignee: SUNREX TECHNOLOGY CORP., Taichung (TW)

( * ) Notice: Subject to any disclaimer, the term of this patent is extended or adjusted under 35 U.S.C. 154(b) by 0 days.

(21) Appl. No.: 15/051,102

(22) Filed: Feb. 23, 2016

(65) Prior Publication Data

US 2017/0243704 A1 Aug. 24, 2017

(51) Int. Cl.
*H01H 13/70* (2006.01)
*H01H 13/14* (2006.01)
*H01H 13/52* (2006.01)

(52) U.S. Cl.
CPC ..... *H01H 13/14* (2013.01); *H01H 13/52* (2013.01)

(58) Field of Classification Search
CPC .... H01H 13/7065; H01H 3/125; H01H 13/14; H01H 13/52
USPC ..... 200/344
See application file for complete search history.

(56) References Cited

U.S. PATENT DOCUMENTS 7,312,414 B2 * 12/2007 Yatsu ..... H01H 3/125 200/344
2008/0185279 A1 * 8/2008 Lin ..... H01H 3/125 200/344
2012/0118715 A1 * 5/2012 Lin ..... H01H 3/125 200/344
2013/0334019 A1 * 12/2013 Lan ..... H01H 3/125 200/344

FOREIGN PATENT DOCUMENTS

TW 201112295 A1 4/2011
TW M401162 U1 4/2011
TW M412416 U1 9/2011

* cited by examiner

*Primary Examiner* — Edwin A. Leon
*Assistant Examiner* — Lheiren Mae A Caroc
(74) *Attorney, Agent, or Firm* — DLA Piper LLP (US)

(57) ABSTRACT

A linkage mechanism includes a left wing having two left arms, two left supporting rods that are respectively formed on the left arms, and two left sliding rods that are respectively formed on the left arms, a right wing having two right arms, two right supporting rods that are respectively formed on the right arms, and two right connecting rods that are respectively formed on the right arms, and a hinge unit having two left hinge pins, two right hinge pins, two left hinge holes and two right holes. Each left hinge hole is formed in a respective left arm and is engaged with a respective right hinge pin. Each right hinge hole is formed in a respective right arm and is engaged with a respective left hinge pin.

9 Claims, 13 Drawing Sheets

LINKAGE MECHANISM AND PRESS KEY INCLUDING THE SAME

FIELD

The disclosure relates to a press key, more particularly to a press key including a linkage mechanism.

BACKGROUND

As shown in FIGS. 1 and 2, a first conventional press key 10 includes a bottom board 11, a keycap 12, a linkage mechanism 13 mounted between the bottom board 11 and the keycap 12, and two springs 14. The linkage mechanism 13 has two linking members 15, each of which has two parallel supporting arms 151, 152, a connecting shaft 153 connected between the supporting arms 151, 152, two sliding rods 154 respectively formed on two ends of the connecting shaft 153 and slidably and rotatably connected to the bottom board 11, two supporting rods 155 respectively formed on outer ends of the supporting arms 151, 152 and rotatably connected to the keycap 12, a one-tooth piece 156 formed on one of the supporting arms 151, 152, and a two-teeth piece 157 formed on the other one of the supporting arms 151, 152. The one-tooth piece 156 of one of the linking members 15 engages the two-teeth piece 157 of the other one of the linkage members 15 to form a gear hinge 158. The two-teeth piece 157 of the one of the linking members 15 engages the one-tooth piece 156 of the other one of the linkage members 15 to form another gear hinge 158 (only one gear hinge 158 is visible in FIG. 2). Each of the springs 14 is mounted between the bottom board 11 and a respective one of the connecting shafts 153.

Referring to FIGS. 3 and 4, a second conventional press key 20 includes a bottom board 21, a keycap 22, and a linkage mechanism 23. The bottom board 21 has two receiving units 211, each of which has an inner sliding groove 2111, and two outer sliding grooves 2112. The linkage mechanism 23 has two arm members 24, each of which has a first arm portion 241, a second arm portion 242 parallel to the first arm portion 241, a receiving cavity 243 formed in the first arm portion 241, an abutting portion 244 formed on the first arm portion 241, an inner supporting rod 245 and a first outer supporting rod 246 formed on the first arm portion 241, and a protruding portion 247, a wing portion 248 and a second outer supporting rod 249 formed on the second arm portion 242. For one of the arm members 24, the inner supporting rod 245 slidably and rotatably engages the inner sliding groove 2111 of one of the receiving units 211, the first outer supporting rod 246 slidably and rotatably engages one of the outer sliding grooves 2112 of the one of the receiving units 211, and the second outer supporting rod 249 slidably and rotatably engages one of the outer sliding grooves 2112 of the other one of the receiving units 211. For the other one of the arm members 24, the inner supporting rod 245 slidably and rotatably engages the inner sliding groove 2111 of the other one of the receiving units 211, the first outer supporting rod 246 slidably and rotatably engages the other one of the outer sliding grooves 2112 of the other one of the receiving units 211, and the second outer supporting rod 249 slidably and rotatably engages the other one of the outer sliding grooves 2112 of the one of the receiving units 211. Each of the arm members 24 further has a connecting shaft 240 connected between the first arm portion 241 and the second arm portion 242, and slidably and rotatably connected to the keycap 22. The protruding portion 247 of each of the arm members 24 is received in the receiving cavity 243 of the other one of the arm members 24, and abuts against the abutting portion 244 of the other one of the arm members 24, such that the protruding portion 247 and the wing portion 248 of one of the arm members 24 cooperate with the receiving cavity 243 and the abutting portion 244 of the other one of the arm members 24 to forma gear hinge 230, and that the protruding portion 247 and the wing portion 248 of the other one of the arm members 24 cooperate with the receiving cavity 243 and the abutting portion 244 of the one of the arm members 24 to form another gear hinge 230.

However, due to the fact that, for each gear hinge 158 of the first conventional press key 10, the engagement between the one-tooth piece 156 and the two-teeth piece 157 relies merely on the abutment of the one-tooth piece 156 against the two-teeth piece 157, and that, for each gear hinge 230 of the second conventional press key 20, the connection between the first arm portion 241 and the second arm portion 242 relies merely on the abutment of the protruding portion 247 against the abutting portion 244, the linkage mechanism 13 of the first conventional press key 10 and the linkage mechanism 23 of the second conventional press key 20 cannot be pre-assembled, thereby resulting in relatively low assembly efficiencies of the first conventional press key 10 and the second conventional press key 20. Besides, the structural strengths of the gear hinges 158 of the first conventional press key 10 and the gear hinges 230 of the second conventional press key 20 are not great, thereby resulting in relatively high damage rates of the first conventional press key 10 and the second conventional press key 20. Furthermore, the structure of the bottom board 21 of the second conventional press key 20 is complicated and thus requires relatively high manufacturing costs.

SUMMARY

Therefore, an object of the disclosure is to provide a linkage mechanism that can alleviate the drawbacks associated with the abovementioned prior art.

Accordingly, a linkage mechanism of the present disclosure includes a left wing, a right wing, and a hinge unit. The left wing has two left arms parallel to each other, two left supporting rods respectively formed on the left arms, and two left sliding rods respectively formed on the left arms. Each of the left arms has a left sliding section and a left linking section divided by a respective one of the left supporting rods. Each of the left sliding rods is formed on the left sliding section of a respective one of the left arms. The right wing has two right arms parallel to each other, two right supporting rods respectively formed on the right arms, and two right connecting rods respectively formed on the right arms. Each of the right arms has a right connecting section and a right linking section divided by a respective one of the right supporting rods. Each of the right connecting rods is formed on the right connecting section of a respective one of the right arms. The hinge unit has two left hinge pins, two right hinge pins, two left hinge holes, and two right hinge holes. Each of the left hinge pins is formed on the left linking section of a respective one of the left arms and is parallel to the left supporting rods. Each of the right hinge pins is formed on the right linking section of a respective one of the right arms and is parallel to the right supporting rods. Each of the left hinge holes is formed in the left linking section of a respective one of the left arms between a respective one of the left hinge pins and a respective one of the left supporting rods, is parallel to the left supporting rods, and is engaged with a respective one of the right hinge pins. Each of the right hinge holes is formed in the right linking section of a respective one of the right arms between a respective one of the right hinge pins and a respective one of the right supporting rods, is parallel to the right supporting rods, and is engaged with a respective one of the left hinge pins. Each of the left and right hinge pins has a lifting portion and a pressing portion, and each of the left and right hinge holes has a lifted portion and a pressed portion. When the left wing is rotated about the left supporting rod and when the right wing is rotated about the right supporting rod, the lifted portion of each of the left hinge holes is disposed in a moving path of the lifting portion of a respective one of the right hinge pins, the pressed portion of each of the left hinge holes is disposed in a moving path of the pressing portion of a respective one of the right hinge pins, the lifted portion of each of the right hinge holes is disposed in a moving path of the lifting portion of a respective one of the left hinge pins, and the pressed portion of each of the right hinge holes is disposed in a moving path of the pressing portion of a respective one of the left hinge pins.

Another object of the disclosure is to provide a press key that includes the abovementioned linkage mechanism.

Accordingly, a press key of the present disclosure includes a bottom board, a keycap, and a linkage mechanism mounted between the bottom board and the keycap, and is operable to move the keycap between a lifted position and a descended position. The linkage mechanism includes a left wing, a right wing, and a hinge unit. The left wing has two left arms parallel to each other, two left supporting rods respectively formed on the left arms and rotatably connected to the bottom board, and two left sliding rods respectively formed on the left arms and rotatably and slidably connected to the keycap. Each of the left arms has a left sliding section and a left linking section divided by a respective one of the left supporting rods. Each of the left sliding rods is formed on the left sliding section of a respective one of the left arms. The right wing has two right arms parallel to each other, two right supporting rods respectively formed on the right arms and rotatably connected to the bottom board, and two right connecting rods respectively formed on the right arms and rotatably connected to the keycap. Each of the right arms has a right connecting section and a right linking section divided by a respective one of the right supporting rods. Each of the right connecting rods is formed on the right connecting section of a respective one of the right arms. The hinge unit has two left hinge pins, two right hinge pins, two left hinge holes, and two right hinge holes. Each of the left hinge pins is formed on the left linking section of a respective one of the left arms and is parallel to the left supporting rods. Each of the right hinge pins is formed on the right linking section of a respective one of the right arms and is parallel to the right supporting rods. Each of the left hinge holes is formed in the left linking section of a respective one of the left arms between a respective one of the left hinge pins and a respective one of the left supporting rods, is parallel to the left supporting rods, and is engaged with a respective one of the right hinge pins. Each of the right hinge holes is formed in the right linking section of a respective one of the right arms between a respective one of the right hinge pins and a respective one of the right supporting rods, is parallel to the right supporting rods, and is engaged with a respective one of the left hinge pins. Each of the left and right hinge pins has a lifting portion and a pressing portion, and each of the left and right hinge holes has a lifted portion and a pressed portion. When the keycap moves between the lifted position and the descended position while the left wing is rotated about the left supporting rod and where the right wing is rotated about the right supporting rod, the lifted portion of each of the left hinge holes is disposed in a moving path of the lifting portion of a respective one of the right hinge pins, the pressed portion of each of the left hinge holes is disposed in a moving path of the pressing portion of a respective one of the right hinge pins, the lifted portion of each of the right hinge holes is disposed in a moving path of the lifting portion of a respective one of the left hinge pins, and the pressed portion of each of the right hinge holes is disposed in a moving path of the pressing portion of a respective one of the left hinge pins.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
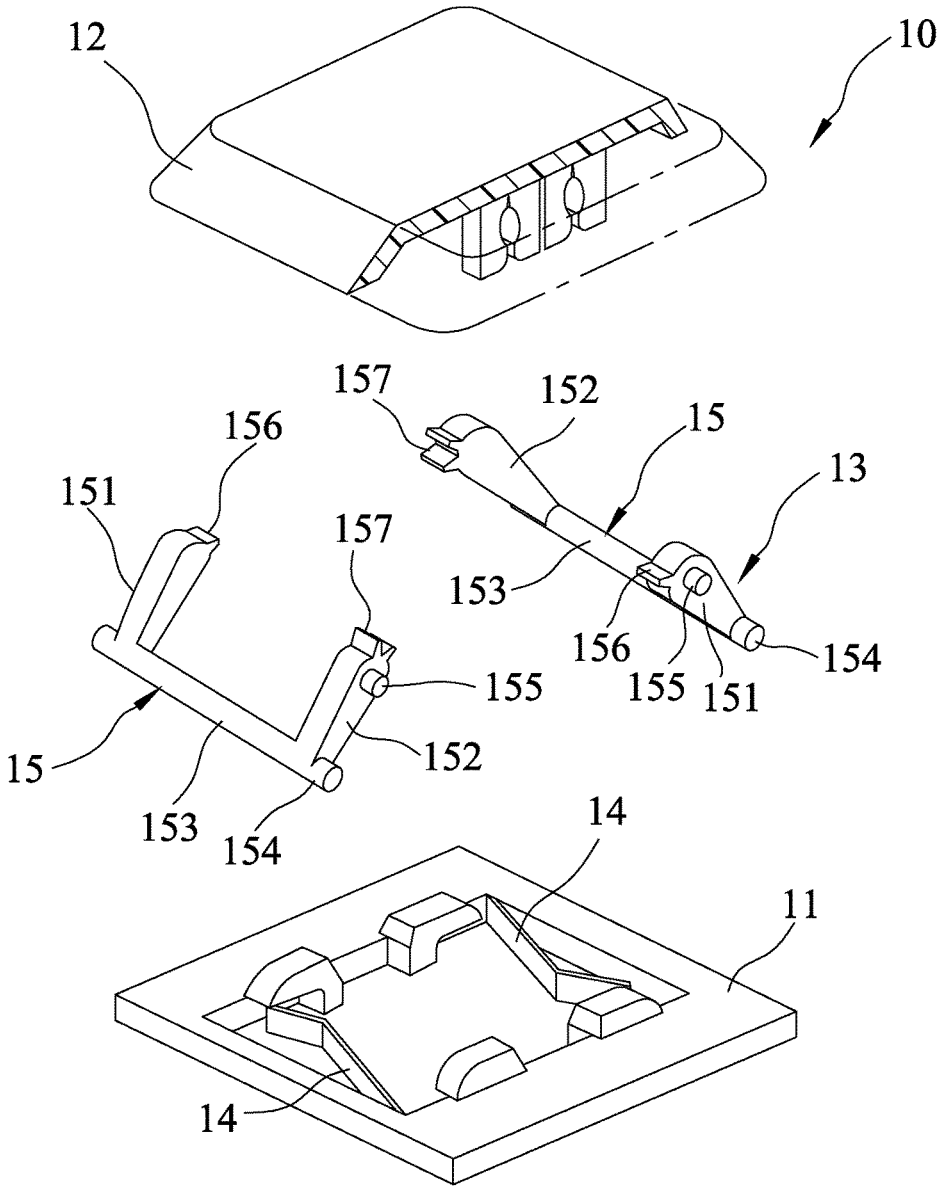
FIG.1 PRIOR ART
FIG. 1 is an exploded perspective view of a first conventional press key.
Figure 2:
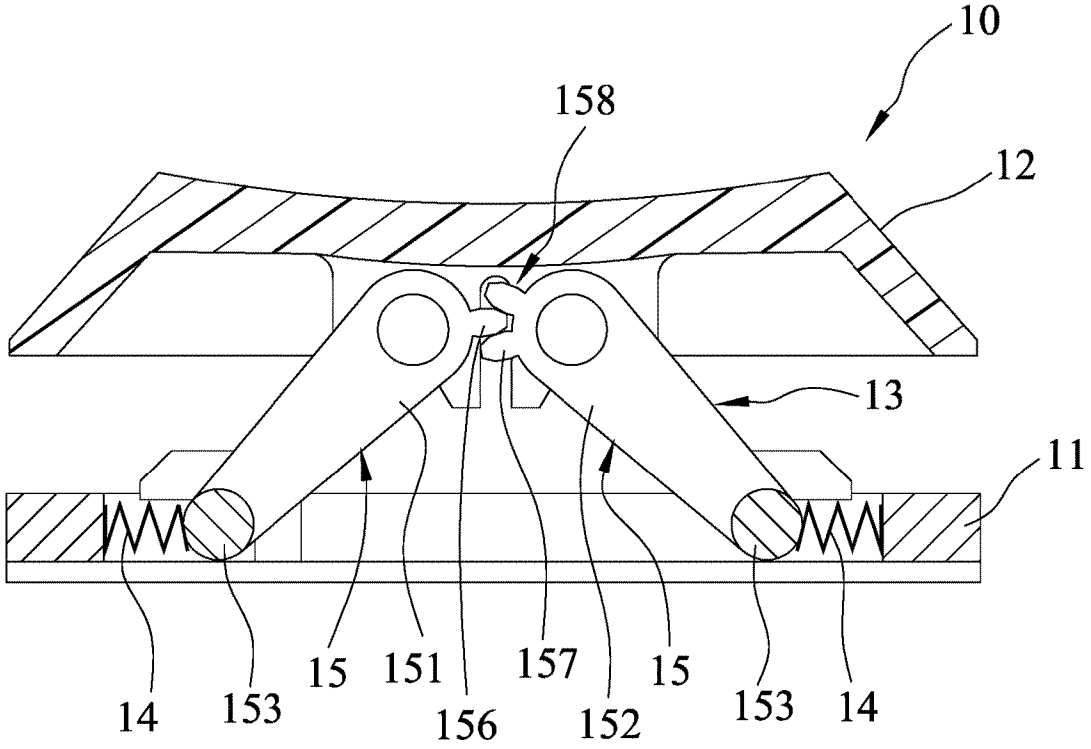
FIG.2 PRIOR ART
FIG. 2 is a sectional view of the first conventional press key.
Figure 3:
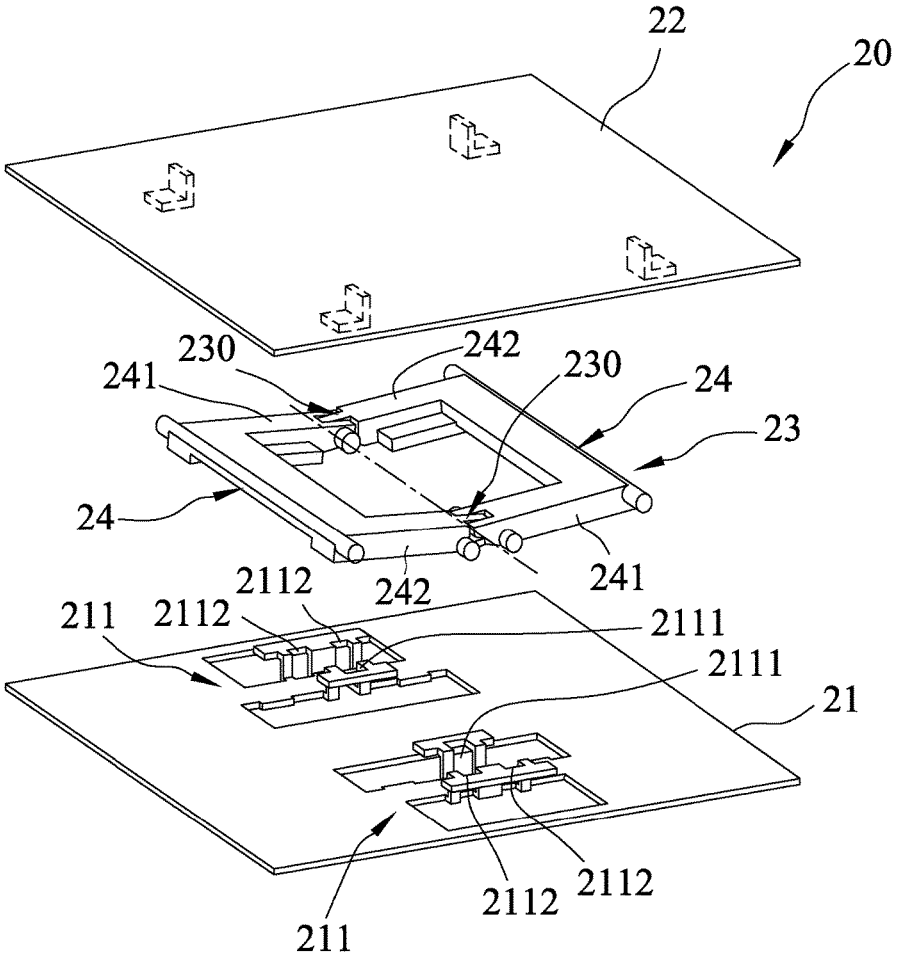
FIG.3 PRIOR ART
FIG. 3 is a partly exploded perspective view of a second conventional press key.
Figure 4:
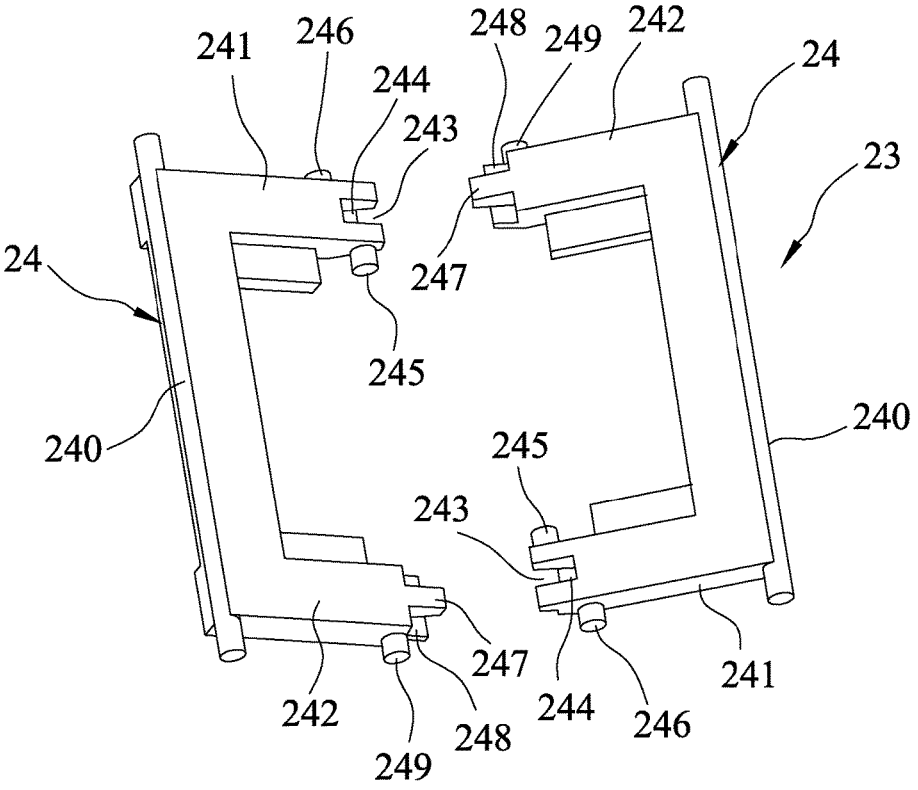
FIG.4 PRIOR ART
FIG. 4 is an exploded perspective view of a linkage mechanism of the second conventional press key.
Figure 5:
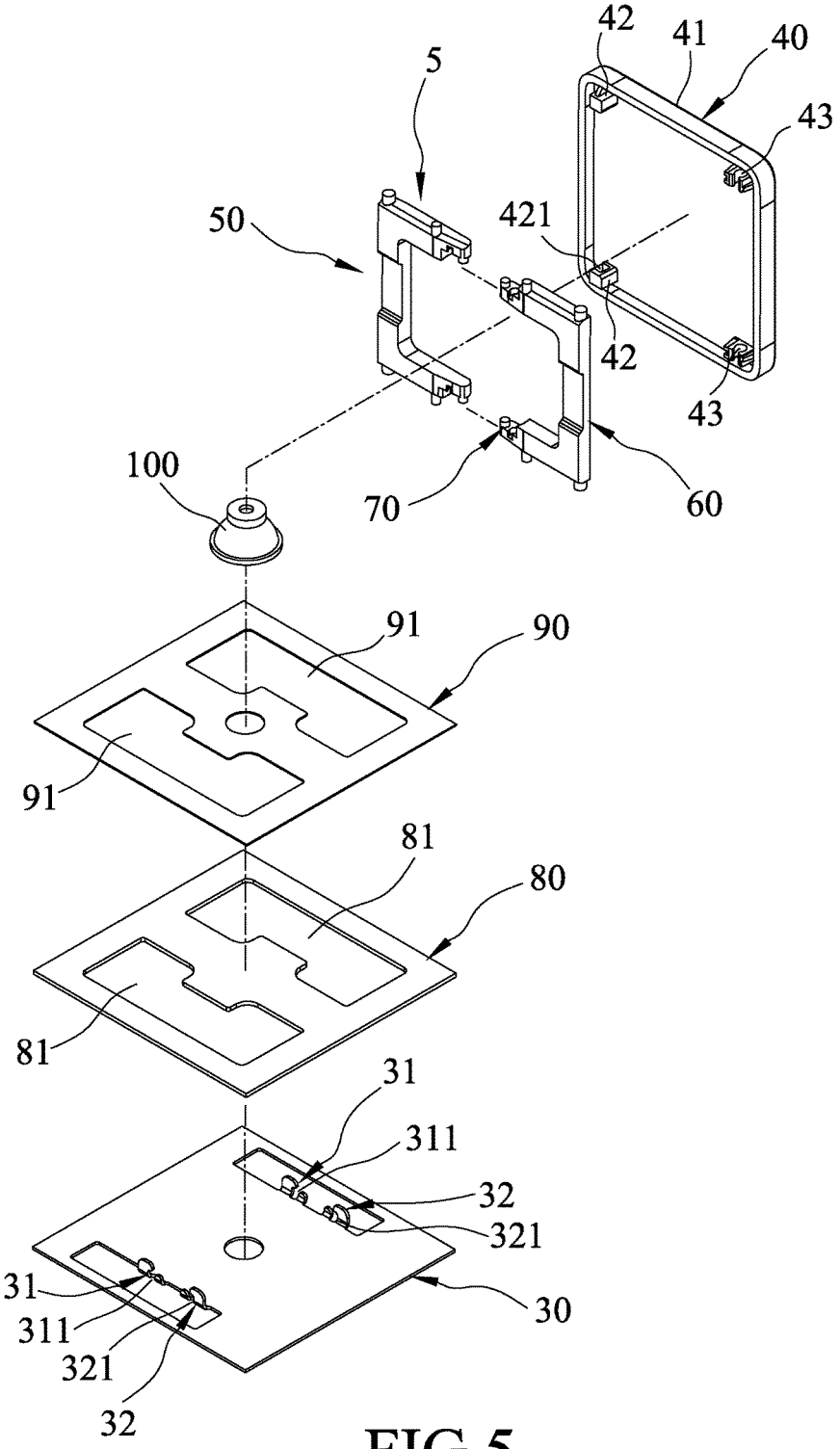
FIG. 5 is an exploded perspective view of an embodiment of a press key according to the disclosure.

As shown in FIG. 5, an embodiment of a press key according to the present disclosure includes a bottom board 30, a keycap 40, a linkage mechanism 5, a circuit board 80, an insulating film 90, and a resilient member 100.

The bottom board 30 has two left receiving units 31 opposite to each other in a front-rear direction and two right receiving units 32 opposite to each other in the front-rear direction. Each of the left receiving units 31 has a left receiving hole 311 and each of the right receiving units 32 has a right receiving hole 321.

The keycap 40 has a main body 41, two left receiving blocks 42 opposite to each other in the front-rear direction and formed on a bottom end of the main body 41, and two right receiving blocks 43 opposite to each other in the front-rear direction and formed on the bottom end of the main body 41. Each of the left receiving blocks 42 has a sliding groove 421 that opens toward a left side of the keycap 40.

Figure 6:
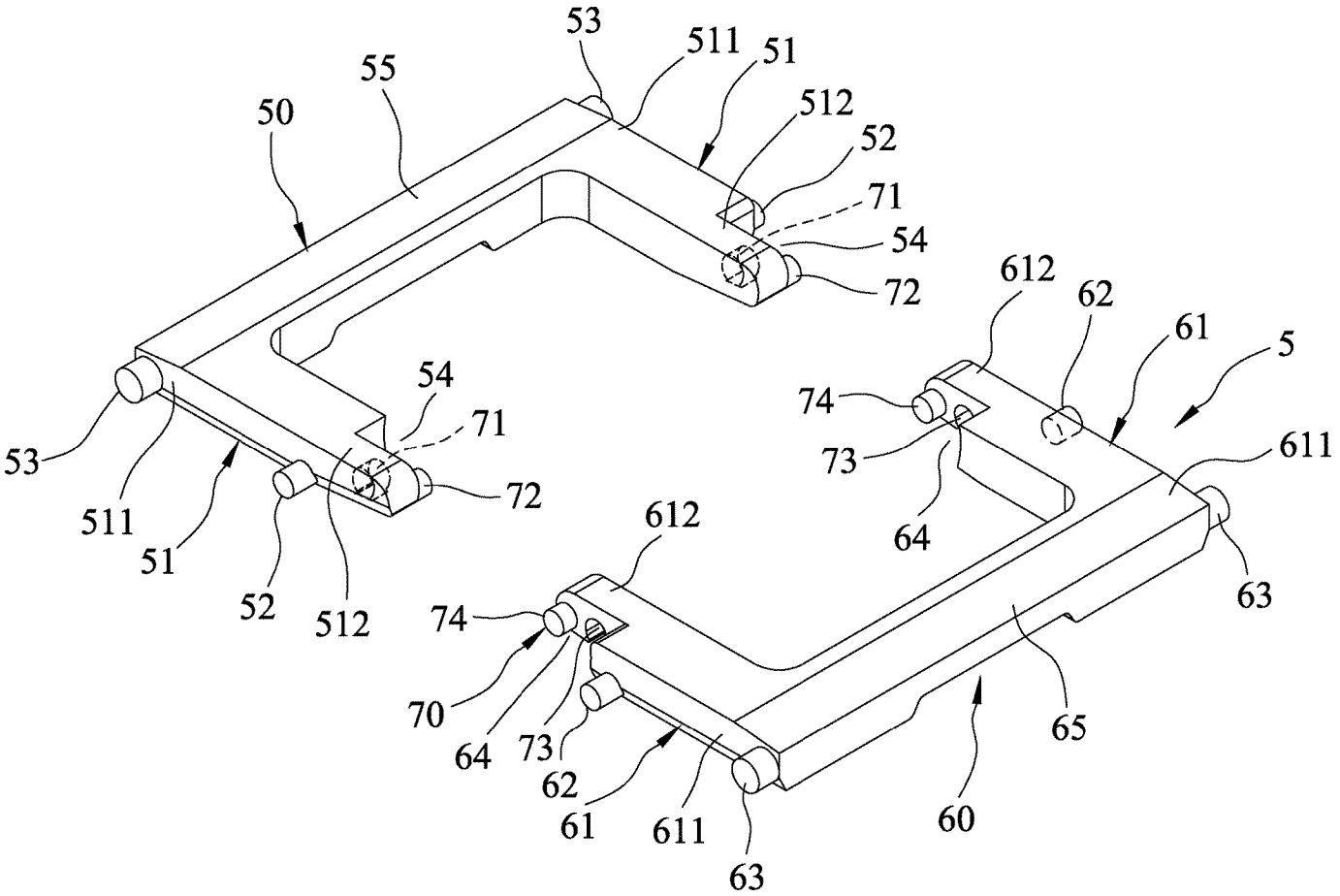
FIG. 6 is an exploded perspective view of a linkage mechanism of the embodiment.
Figure 7:
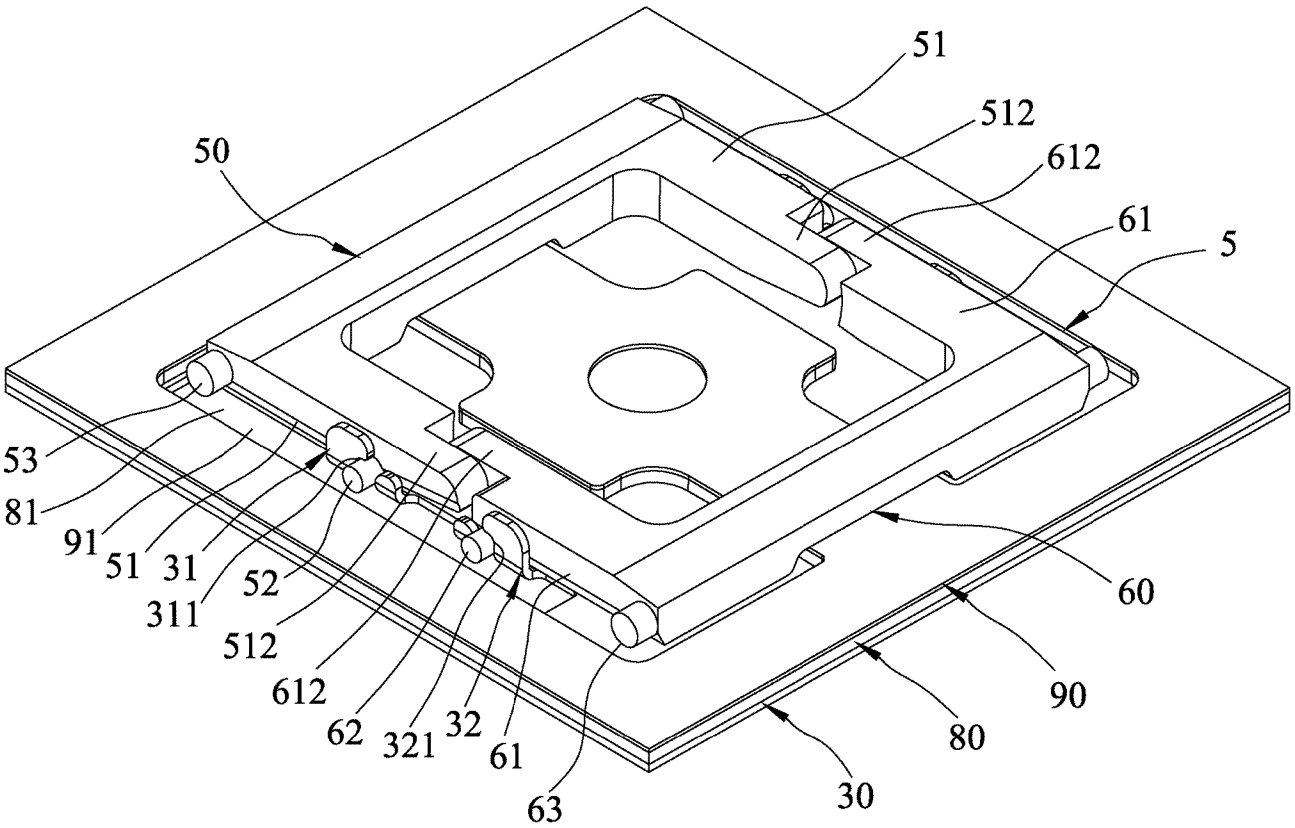
FIG. 7 is an assembled perspective view of the embodiment with a keycap being omitted.
Figure 8:
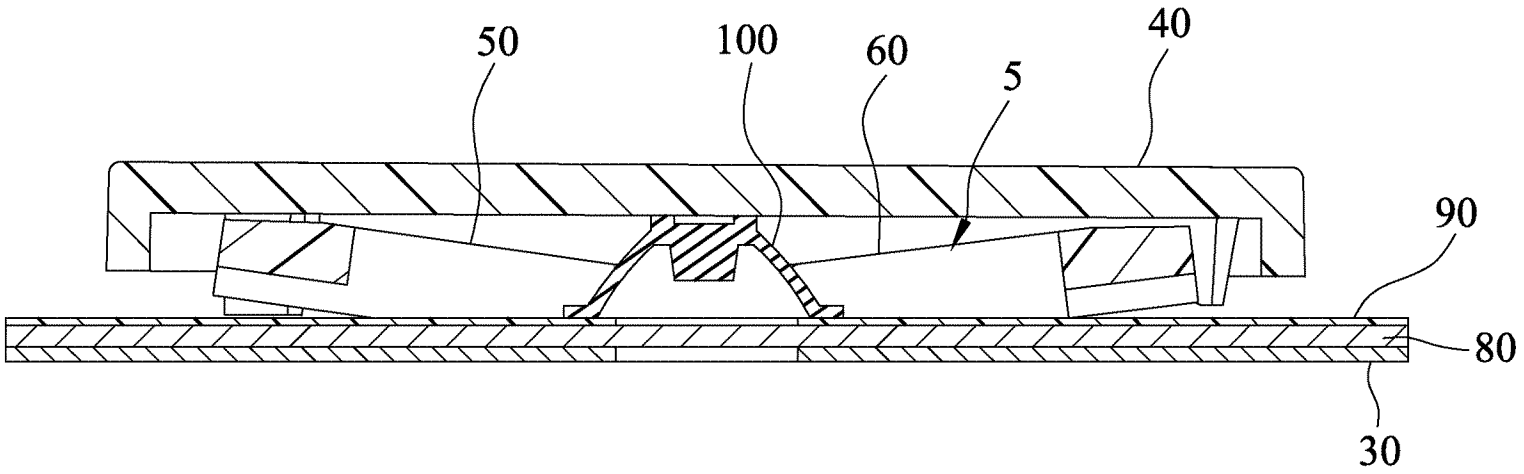
FIG. 8 is a sectional view of the embodiment, illustrating the keycap at a lifted position.
Figure 9:
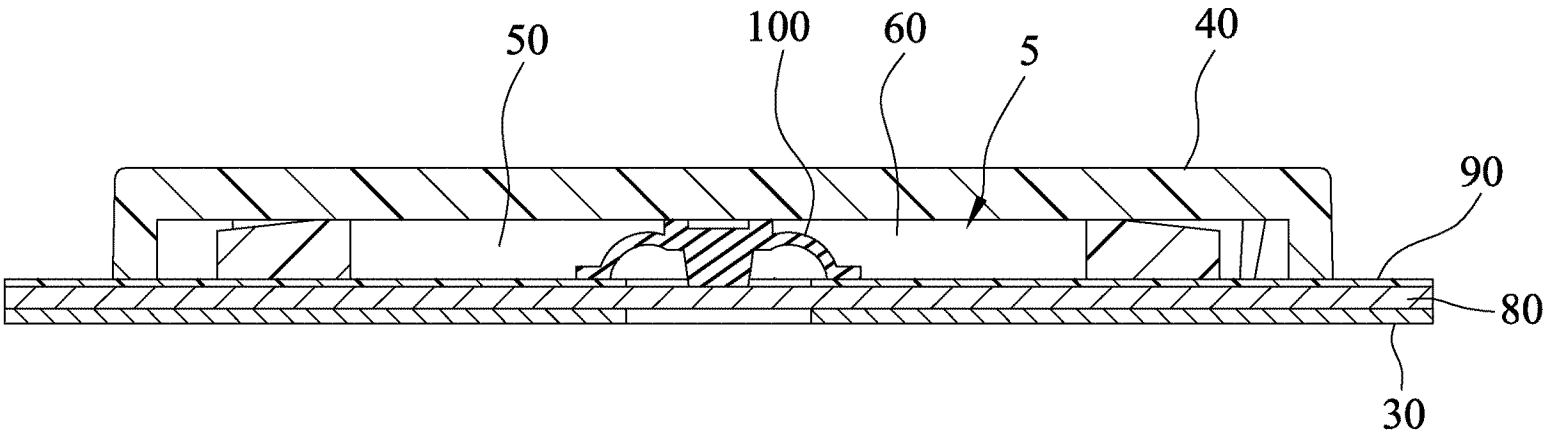
FIG. 9 is a view similar to FIG. 8, but illustrating the keycap at a descended position.
Figure 12:
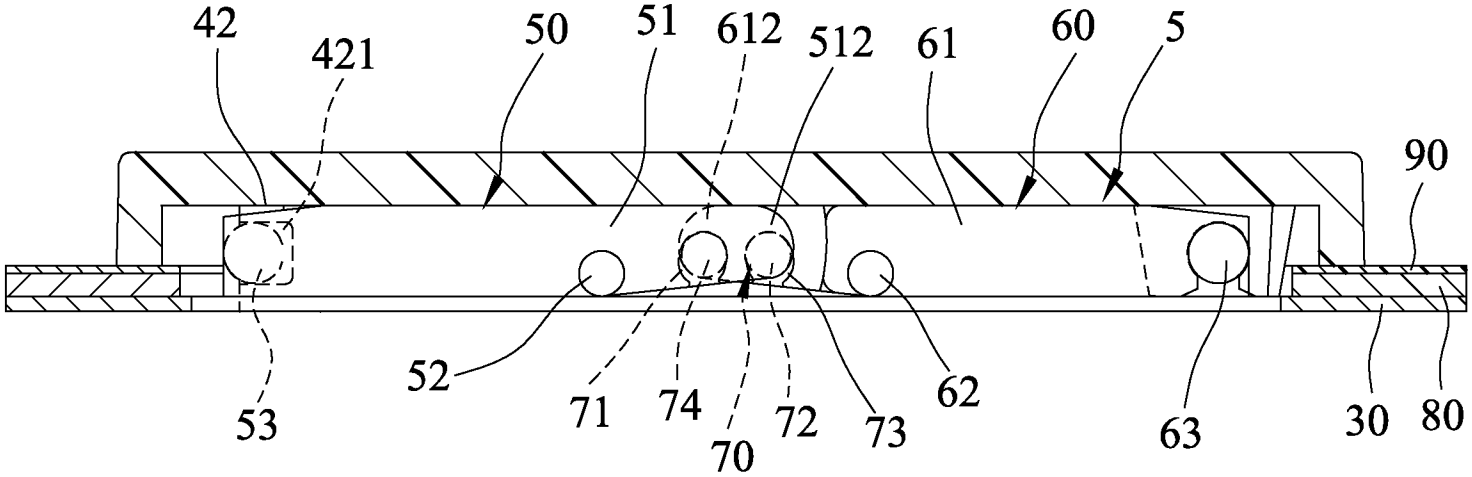
FIG. 12 is still another partly sectional view of the embodiment, illustrating the status of the hinge unit of the linkage mechanism when the keycap is at the lifted position.

As shown in FIGS. 5, 6, and 7, the linkage mechanism 5 is mounted between the bottom board 30 and the keycap 40, and is operable to move the keycap 40 relative to the bottom board 30 between a lifted position (see FIGS. 8 and 10) and a descended position (see FIGS. 9 and 12). The linkage mechanism 5 includes a left wing 50, a right wing 60, and a hinge unit 70.

The left wing 50 has two parallel left arms 51 spaced apart from each other in the front-rear direction, two left supporting rods 52 respectively formed on the left arms 51, extending in the front-rear direction, and rotatably and respectively engaging the left receiving holes 311 of the left receiving units 31 of the bottom board 30, and two left sliding rods 53 respectively formed on the left arms 51, and rotatably, slidably and respectively engaging the receiving grooves 421 of the left receiving blocks 42 of the keycap 40. Each of the left arms 51 has a left sliding section 511 and a left linking section 512 divided by a respective one of the left supporting rods 52, and each of the left sliding rods 53 is formed on the left sliding section 511 of a respective one of the left arms 51.

The left wing 50 further has two left cavities 54 respectively formed in the left linking sections 512 of the left arms 51, and a left connecting shaft 55 connected between the left sliding sections 511 of the left arms 51. The left connecting shaft 55 extends in the front-rear direction, and the left arms 51 are perpendicular to the left connecting shaft 55.

The right wing 60 has two parallel right arms 61 spaced apart from each other in the front-rear direction, two right supporting rods 62 respectively formed on the right arms 61, extending in the front-rear direction, and rotatably and respectively engaging the right receiving holes 321 of the right receiving units 32 of the bottom board 30, and two right connecting rods 63 respectively formed on the right arms 61 and rotatably and respectively connected to the right receiving blocks 43 of the keycap 40. Each of the right arms 61 has a right connecting section 611 and a right linking section 612 divided by a respective one of the right supporting rods 62, and each of the right connecting rods 63 is formed on the right connecting section 611 of a respective one of the right arms 61.

The right wing 60 further has two right cavities 64 respectively formed in the right linking sections 612 of the right arms 61, and a right connecting shaft 65 connected between the right connecting sections 611 of the right arms 61. The right connecting shaft 65 extends in the front-rear direction, and the right arms 61 are perpendicular to the right connecting shaft 65.

The left linking sections 512 of the left arms 51 are respectively received in the right cavities 64 of the right wing 60, and the right linking sections 612 of the right arms 61 are respectively received in the left cavities 54 of the left wing 50.

Figure 11:
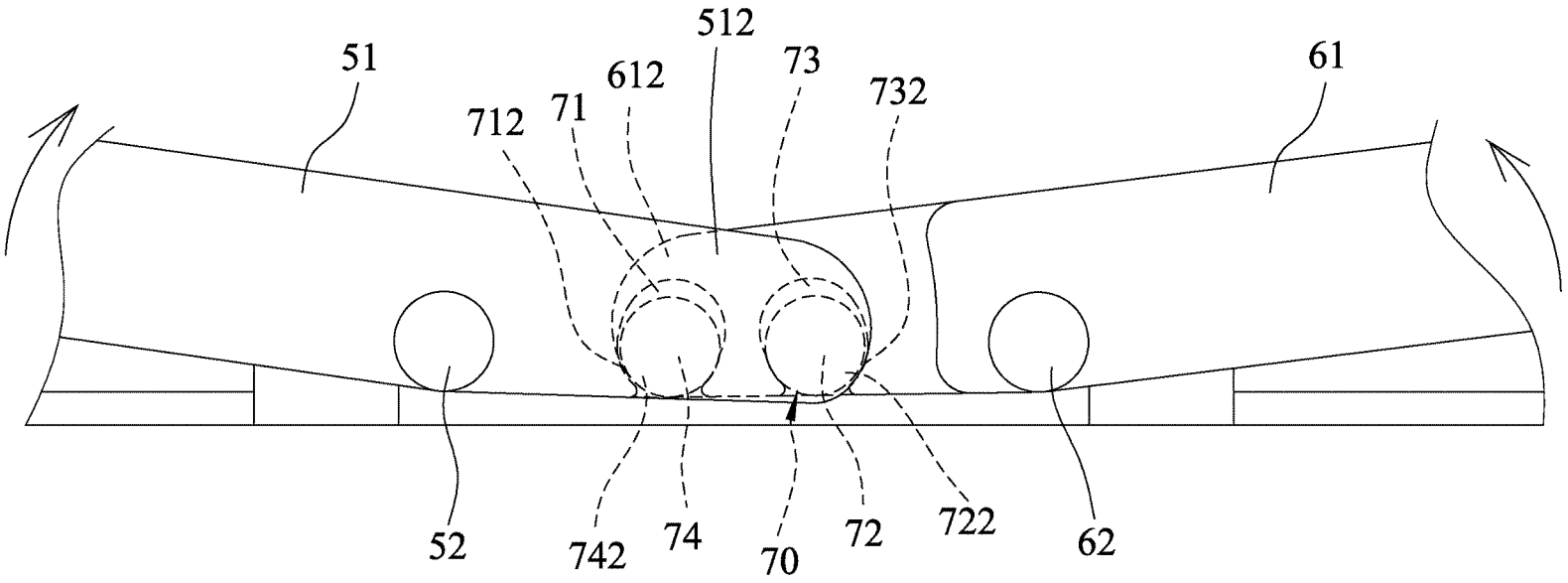
FIG. 11 is an enlarged fragmentary view of FIG. 10.
Figure 13:
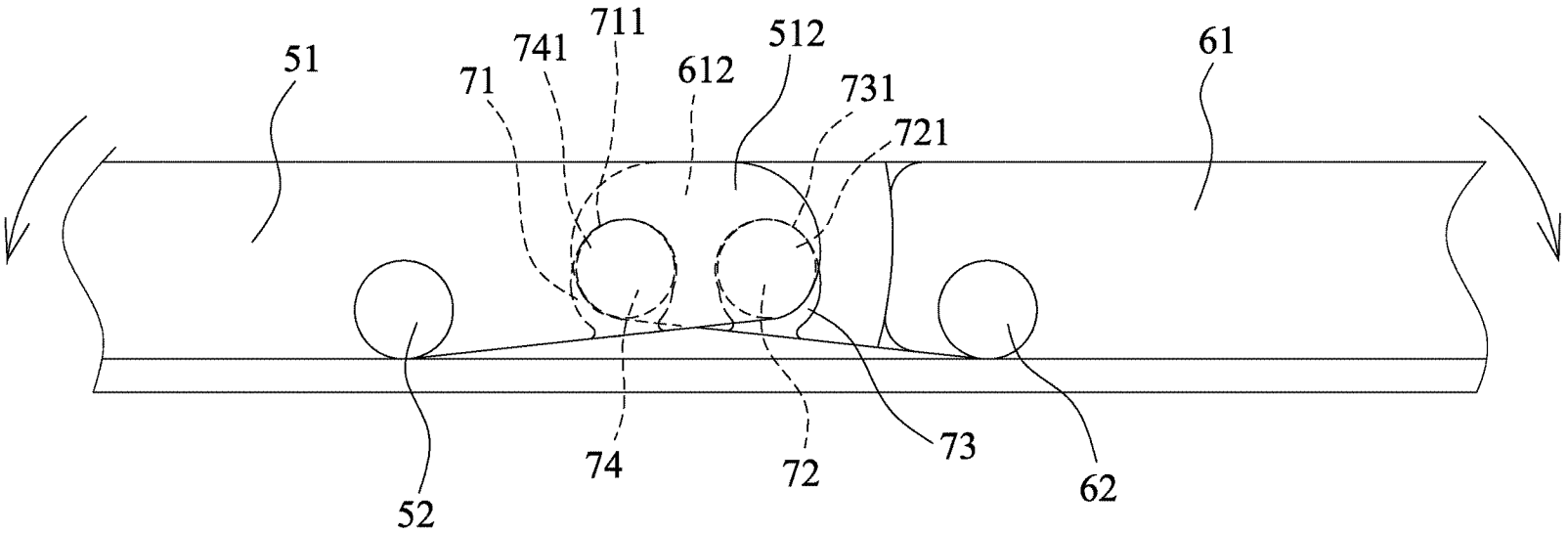
FIG. 13 is an enlarged fragmentary view of FIG. 12.

Referring to FIGS. 6, 11, and 13, the hinge unit 70 has two left hinge pins 72, two right hinge pins 74, two left hinge holes 71, and two right hinge holes 73. Each of the left hinge pins 72 is formed on the left linking section 512 of a respective one of the left arms 51, and is parallel to the left supporting rods 52. Each of the right hinge pins 74 is formed on the right linking section 612 of a respective one of the right arms 61, and is parallel to the right supporting rods 62. Each of the left hinge holes 71 is formed in the left linking section 512 of a respective one of the left arms 51 between a respective one of the left hinge pins 72 and a respective one of the left supporting rods 52, is parallel to the left supporting rods 52, and is engaged with a respective one of the right hinge pins 74. Each of the right hinge holes 73 is formed in the right linking section 612 of a respective one of the right arms 61 between a respective one of the right hinge pins 74 and a respective one of the right supporting rods 62, is parallel to the right supporting rods 62, and is engaged with a respective one of the left hinge pins 72. Each of the left and right hinge pins 72, 74 has a lifting portion 721, 741 and a pressing portion 722, 742. Each of the left and right hinge holes 71, 73 has a lifted portion 711, 731 and a pressed portion 712, 732. When the keycap 40 moves between the lifted position and the descended position while the left wing 50 is rotated about the left supporting rod 52 and the right wing 60 is rotated about the right supporting rod 62, the lifted portion 711 of each of the left hinge holes 71 is disposed in a moving path of the lifting portion 741 of a respective one of the right hinge pins 74, the pressed portion 712 of each of the left hinge holes 71 is disposed in a moving path of the pressing portion 742 of a respective one of the right hinge pins 74, the lifted portion 731 of each of the right hinge holes 73 is disposed in a moving path of the lifting portion 721 of a respective one of the left hinge pins 72, and the pressed portion 732 of each of the right hinge holes 73 is disposed in a moving path of the pressing portion 722 of a respective one of the left hinge pins 72.

A size of each of the left hinge holes 71 is larger than that of the respective one of the right hinge pins 74, and a size of each of the right hinge holes 73 is larger than that of the respective one of the left hinge pins 72. The left hinge holes 71 and the right hinge holes 73 are non-circular holes.

The left wing 50 has a structure identical to that of the right wing 60 so as to decrease the manufacturing cost of the linkage mechanism 5.

When the left wing 50 and the right wing 60 are coupled together, the left hinge pins 72 are respectively retained in the right hinge holes 73, and the right hinge pins 74 are respectively retained in the left hinge holes 71, so that the left wing 50 and the right wing 60 are inseparable from each other. Therefore, the linkage mechanism 5 can be pre-assembled during the assembly of the press key.

Referring to FIGS. 6, 7, and 8, the circuit board 80 is mounted on a top end of the bottom board 30, and has two first through holes 81. The circuit board 80 may be a film circuit board or a printed circuit board.

The insulating film 90 is mounted on a top end of the circuit board 80, and has two second through holes 91. The left and right receiving units 31, 32 of the bottom board 30 extend respectively through the first through holes 81 of the circuit board 80, and extend respectively through the second through holes 91 of the insulating film 90.

The resilient member 100 is mounted between the insulating film 90 and the keycap 40 for biasing resiliently the keycap 40 with a resilient force toward the lifted position. The resilient member 100 may be made of rubber or be a spring that can offer the resilient force.

Figure 10:
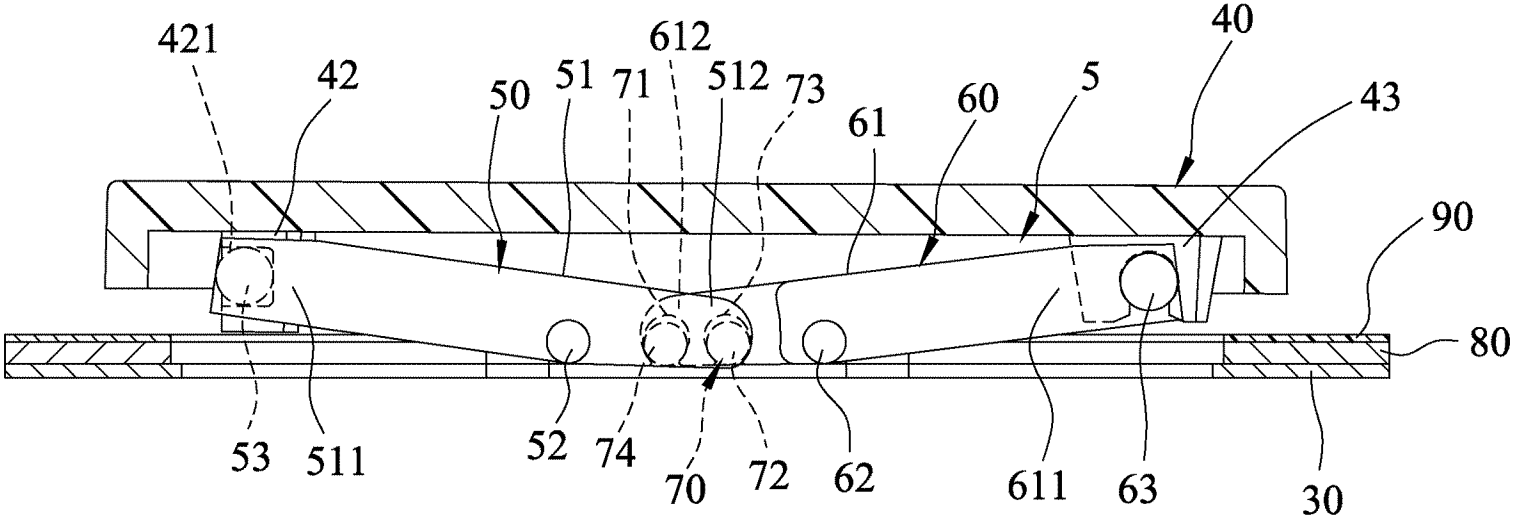
FIG. 10 is another partly sectional view of the embodiment, illustrating the status of a hinge unit of the linkage mechanism when the keycap is at the lifted position.

In operation, as shown in FIGS. 8, 10, and 11, when the keycap 40 is at the lifted position, the configuration of the linkage mechanism 5 is V-shaped from a side view. At this time, the pressing portions 722 of the left hinge pins 72 are respectively moved to the pressed portions 732 of the right hinge holes 73, and the pressing portions 742 of the right hinge pins 74 are respectively moved to the pressed portions 712 of the left hinge holes 71.

As shown in FIGS. 9, 12, and 13, when the keycap 40 is pressed to the descended position, the resilient member 100 is compressed, and a middle portion of the resilient member 100 contacts the circuit board 80 to send out an electrical signal, the left arms 51 rotate counterclockwise about the left supporting rods 52, and the right arms 61 rotate clockwise about the right supporting rods 62. At this time, the lifting portions 721 of the left hinge pins 72 are respectively moved to the lifted portions 731 of the right hinge holes 73 and slightly and respectively lift the right linking sections 612 of the right arms 61, and the lifting portions 741 of the right hinge pins 74 are respectively moved to the lifted portions 711 of the left hinge holes 71 and slightly and respectively lift the left linking sections 512 of the left arms 51. Furthermore, the left sliding rods 53 respectively slide leftwardly in the sliding grooves 421 of the keycap 40 so as to permit smooth rotations of the left wing 50 and the right wing 60.

Referring to FIGS. 8, 10, and 11, when the keycap 40 is not pressed, the keycap 40 is biased back toward the lifted position by the resilient force of the resilient member 100, and the left sliding sections 511 of the left wing 50 and the right connecting sections 611 of the right wing 60 are pushed to drive the left arms 51 to rotate clockwise about the left supporting rods 52 and to drive the right arms 61 to rotate counterclockwise about the right supporting rods 62. Consequently, the pressing portions 722 of the left hinge pins 72 are respectively moved to the pressed portions 732 of the right hinge holes 73 and push down the right linking sections 612 of the right arms 61, and the pressing portions 742 of the right hinge pins 74 are respectively moved to the pressed portions 712 of the left hinge holes 71 and push down the left linking sections 512 of the left arms 51 until the keycap 40 returns back to the lifted position.

In conclusion, the following are the advantages of the press key according to the present disclosure:

1. Since the linkage mechanism 5 can be pre-assembled, the assembly efficiency thereof is increased.
2. Since the pressing portions 722, 742 of the left and right hinge pins 72, 74 can be respectively moved to the pressed portions 732, 712 of the right and left hinge holes 71, 73 to respectively push down the right linking sections 612 of the right arms 61 and the left linking sections 512 of the left arms 51, and since the lifting portions 721, 741 of the left and right hinge pins 72, 74 can be respectively moved to the lifted portions 731, 711 of the right and left hinge holes 73, 71 to respectively lift the right linking sections 612 of the right arms 61 and the left linking sections 512 of the left arms 51, the structural strength of the hinge unit 70 is increased.
3. The bottom board 30 of the disclosure has a simpler structure compared to the abovementioned bottom board 21 of the second conventional press key 20 and consequently has a lower manufacturing cost.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A linkage mechanism comprising:

a left wing having two left arms that are parallel to each other, two left supporting rods that are respectively formed on said left arms, and two left sliding rods that are respectively formed on said left arms, each of said left arms having a left sliding section and a left linking section that are divided by a respective one of said left supporting rods, each of said left sliding rods being formed on said left sliding section of a respective one of said left arms;

a right wing having two right arms that are parallel to each other, two right supporting rods that are respectively formed on said right arms, and two right connecting rods that are respectively formed on said right arms, each of said right arms having a right connecting section and a right linking section that are divided by a respective one of said right supporting rods, each of said right connecting rods being formed on said right connecting section of a respective one of said right arms; and a hinge unit having two left hinge pins, each being formed on said left linking section of a respective one of said left arms and being parallel to said left supporting rods, two right hinge pins, each being formed on said right linking section of a respective one of said right arms and being parallel to said right supporting rods, two left hinge holes, each being formed in said left linking section of a respective one of said left arms between a respective one of said left hinge pins and a respective one of said left supporting rods, being parallel to said left supporting rods, and being engaged with a respective one of said right hinge pins, and two right hinge holes, each being formed in said right linking section of a respective one of said right arms between a respective one of said right hinge pins and a respective one of said right supporting rods, being parallel to said right supporting rods, and being engaged with a respective one of said left hinge pins, wherein each of said left and right hinge pins has a lifting portion and a pressing portion, each of said left and right hinge holes having a lifted portion and a pressed portion, and wherein, when said left wing is rotated about said left supporting rod and when said right wing is rotated about said right supporting rod, said lifted portion of each of said left hinge holes is disposed in a moving path of said lifting portion of a respective one of said right hinge pins, said pressed portion of each of said left hinge holes is disposed in a moving path of said pressing portion of a respective one of said right hinge pins, said lifted portion of each of said right hinge holes is disposed in a moving path of said lifting portion of a respective one of said left hinge pins, and said pressed portion of each of said right hinge holes is disposed in a moving path of said pressing portion of a respective one of said left hinge pins.

2. The linkage mechanism as claimed in claim 1, wherein said left wing has a structure identical to that of said right wing.

3. The linkage mechanism as claimed in claim 1, wherein a size of each of said left hinge holes is larger than that of the respective one of said right hinge pins, a size of each of said right hinge holes being larger than that of the respective one of said left hinge pins, said left hinge holes and said right hinge holes being non-circular holes.

4. A linkage mechanism comprising:

a left wing having two left arms that are parallel to each other, two left supporting rods that are respectively formed on said left arms, and two left sliding rods that are respectively formed on said left arms, each of said left arms having a left sliding section and a left linking section that are divided by a respective one of said left supporting rods, each of said left sliding rods being formed on said left sliding section of a respective one of said left arms;

a right wing having two right arms that are parallel to each other, two right supporting rods that are respectively formed on said right arms, and two right connecting rods that are respectively formed on said right arms, each of said right arms having a right connecting section and a right linking section that are divided by a respective one of said right supporting rods, each of said right connecting rods being formed on said right connecting section of a respective one of said right arms, wherein said left wing has a structure identical to that of said right wing; and a hinge unit having two left hinge pins, each being formed on said left linking section of a respective one of said left arms and being parallel to said left supporting rods, two right hinge pins, each being formed on said right linking section of a respective one of said right arms and being parallel to said right supporting rods, two left hinge holes, each being formed in said left linking section of a respective one of said left arms between a respective one of said left hinge pins and a respective one of said left supporting rods, being parallel to said left supporting rods, and being engaged with a respective one of said right hinge pins, and two right hinge holes, each being formed in said right linking section of a respective one of said right arms between a respective one of said right hinge pins and a respective one of said right supporting rods, being parallel to said right supporting rods, and being engaged with a respective one of said left hinge pins, wherein each of said left and right hinge pins has a lifting portion and a pressing portion, each of said left and right hinge holes having a lifted portion and a pressed portion, wherein, when said left wing is rotated about said left supporting rod and when said right wing is rotated about said right supporting rod, said lifted portion of each of said left hinge holes is disposed in a moving path of said lifting portion of a respective one of said right hinge pins, said pressed portion of each of said left hinge holes is disposed in a moving path of said pressing portion of a respective one of said right hinge pins, said lifted portion of each of said right hinge holes is disposed in a moving path of said lifting portion of a respective one of said left hinge pins, and said pressed portion of each of said right hinge holes is disposed in a moving path of said pressing portion of a respective one of said left hinge pins, and wherein said left wing further has two left cavities respectively formed in said left linking sections of said left arms for respectively receiving said right linking sections of said right arms; and said right wing further has two right cavities respectively formed in said right linking sections of said right arms for respectively receiving said left linking sections of said left arms.

5. A press key comprising:

a bottom board;

a keycap; and a linkage mechanism mounted between said bottom board and said keycap, and is operable to move said keycap between a lifted position and a descended position, said linkage mechanism including a left wing having two left arms that are parallel to each other, two left supporting rods that are respectively formed on said left arms and that are rotatably connected to said bottom board, and two left sliding rods that are respectively formed on said left arms and that are rotatably and slidably connected to said keycap, each of said left arms having a left sliding section and a left linking section that are divided by a respective one of said left supporting rods, each of said left sliding rods being formed on said left sliding section of a respective one of said left arms, a right wing having two right arms that are parallel to each other, two right supporting rods that are respectively formed on said right arms and that are rotatably connected to said bottom board, and two right connecting rods that are respectively formed on said right arms and that are rotatably connected to said keycap, each of said right arms having a right connecting section and a right linking section that are divided by a respective one of said right supporting rods, each of said right connecting rods being formed on said right connecting section of a respective one of said right arms, and a hinge unit having two left hinge pins, each being formed on said left linking section of a respective one of said left arms and being parallel to said left supporting rods, two right hinge pins, each being formed on said right linking section of a respective one of said right arms and being parallel to said right supporting rods, two left hinge holes, each being formed in said left linking section of a respective one of said left arms between a respective one of said left hinge pins and a respective one of said left supporting rods, being parallel to said left supporting rods, and being engaged with a respective one of said right hinge pins, and two right hinge holes, each being formed in said right linking section of a respective one of said right arms between a respective one of said right hinge pins and a respective one of said right supporting rods, being parallel to said right supporting rods, and being engaged with a respective one of said left hinge pins, wherein each of said left and right hinge pins has a lifting portion and a pressing portion, each of said left and right hinge holes having a lifted portion and a pressed portion, and wherein, when said keycap moves between the lifted position and the descended position while said left wing is rotated about said left supporting rod and said right wing is rotated about said right supporting rod, said lifted portion of each of said left hinge holes is disposed in a moving path of said lifting portion of a respective one of said right hinge pins, said pressed portion of each of said left hinge holes is disposed in a moving path of said pressing portion of a respective one of said right hinge pins, said lifted portion of each of said right hinge holes is disposed in a moving path of said lifting portion of a respective one of said left hinge pins, and said pressed portion of each of said right hinge holes is disposed in a moving path of said pressing portion of a respective one of said left hinge pins.

6. The press key as claimed in claim 5, wherein said left wing has a structure identical to that of said right wing.

7. The press key as claimed in claim 5, wherein a size of each of said left hinge holes is larger than that of the respective one of said right hinge pins, a size of each of said right hinge holes being larger than that of the respective one of said left hinge pins, said left hinge holes and said right hinge holes being non-circular holes.

8. The press key as claimed in claim 5, further comprising:

a circuit board mounted on a top end of said bottom board;

an insulating film mounted on a top end of said circuit board; and a resilient member mounted between said insulating film and said keycap for biasing resiliently said keycap toward the lifted position.

9. A press key comprising:

a bottom board;

a keycap; and a linkage mechanism mounted between said bottom board and said keycap, and is operable to move said keycap between a lifted position and a descended position, said linkage mechanism including a left wing having two left arms that are parallel to each other, two left supporting rods that are respectively formed on said left arms and that are rotatably connected to said bottom board, and two left sliding rods that are respectively formed on said left arms and that are rotatably and slidably connected to said keycap, each of said left arms having a left sliding section and a left linking section that are divided by a respective one of said left supporting rods, each of said left sliding rods being formed on said left sliding section of a respective one of said left arms, a right wing having two right arms that are parallel to each other, two right supporting rods that are respectively formed on said right arms and that are rotatably connected to said bottom board, and two right connecting rods that are respectively formed on said right arms and that are rotatably connected to said keycap, each of said right arms having a right connecting section and a right linking section that are divided by a respective one of said right supporting rods, each of said right connecting rods being formed on said right connecting section of a respective one of said right arms, wherein said left wing has a structure identical to that of said right wing, and a hinge unit having two left hinge pins, each being formed on said left linking section of a respective one of said left arms and being parallel to said left supporting rods, two right hinge pins, each being formed on said right linking section of a respective one of said right arms and being parallel to said right supporting rods, two left hinge holes, each being formed in said left linking section of a respective one of said left arms between a respective one of said left hinge pins and a respective one of said left supporting rods, being parallel to said left supporting rods, and being engaged with a respective one of said right hinge pins, and two right hinge holes, each being formed in said right linking section of a respective one of said right arms between a respective one of said right hinge pins and a respective one of said right supporting rods, being parallel to said right supporting rods, and being engaged with a respective one of said left hinge pins, wherein each of said left and right hinge pins has a lifting portion and a pressing portion, each of said left and right hinge holes having a lifted portion and a pressed portion, wherein, when said keycap moves between the lifted position and the descended position while said left wing is rotated about said left supporting rod and said right wing is rotated about said right supporting rod, said lifted portion of each of said left hinge holes is disposed in a moving path of said lifting portion of a respective one of said right hinge pins, said pressed portion of each of said left hinge holes is disposed in a moving path of said pressing portion of a respective one of said right hinge pins, said lifted portion of each of said right hinge holes is disposed in a moving path of said lifting portion of a respective one of said left hinge pins, and said pressed portion of each of said right hinge holes is disposed in a moving path of said pressing portion of a respective one of said left hinge pins, and wherein said left wing further has two left cavities respectively formed in said left linking sections of said left arms for respectively receiving said right linking sections of said right arms; and said right wing further has two right cavities respectively formed in said right linking sections of said right arms for respectively receiving said left linking sections of said left arms.

* * * * *